United States Patent [19]

Ylvisaker

[11] Patent Number: 4,892,744

[45] Date of Patent: Jan. 9, 1990

[54] SINGLE-PLEATED MICROWAVE POPCORN PACKAGE

[75] Inventor: Jon A. Ylvisaker, Marietta, N.Y.

[73] Assignee: Borden, Inc., Columbus, Ohio

[21] Appl. No.: 300,178

[22] Filed: Jan. 23, 1989

Related U.S. Application Data

[63] Continuation of Ser. No. 13,354, Feb. 11, 1987, abandoned.

[51] Int. Cl.[4] ..... B65D 30/00; B65D 75/12; B65D 81/34

[52] U.S. Cl. ..... 426/111; 426/107; 426/118; 426/113; 426/123; 383/100; 383/120; 383/121; 206/632; 206/633

[58] Field of Search ..... 426/107, 111, 113, 234, 426/118, 412, 123; 383/120, 100, 121, 907, 104, 122; 229/DIG. 3, DIG. 14; 206/632, 633

[56] References Cited

U.S. PATENT DOCUMENTS

| | | | |
|---|---|---|---|
| 304,403 | 9/1884 | Benner | 383/120 |
| 2,189,174 | 2/1940 | Hohl | 383/120 |
| 2,361,344 | 10/1944 | Yates | 426/118 |
| 2,628,764 | 2/1953 | Rubinstein et al. | 383/120 |
| 2,858,970 | 11/1958 | Barnes et al. | 426/111 |
| 2,865,768 | 12/1958 | Barnes et al. | 426/111 |
| 3,023,947 | 3/1968 | McDuffie | 383/120 |
| 3,052,554 | 9/1962 | Colman | 426/111 |
| 3,309,006 | 3/1967 | Perry et al. | 383/100 |
| 3,358,903 | 12/1967 | De Stefano et al. | 383/120 |
| 3,370,780 | 2/1968 | Shaw . | |
| 3,570,751 | 3/1971 | Trewella . | |
| 3,615,711 | 10/1971 | Markus et al. | 426/107 |
| 3,851,574 | 12/1974 | Katz et al. | 426/107 |
| 3,873,738 | 3/1975 | Zoeller | 426/111 |
| 3,997,677 | 12/1976 | Hirsch et al. | 426/118 |
| 4,013,798 | 3/1977 | Goltsos | 426/107 |
| 4,038,425 | 7/1977 | Brandberg et al. | 426/107 |
| 4,141,487 | 2/1979 | Faust | 426/111 |
| 4,292,332 | 9/1981 | McHam | 426/118 |
| 4,337,862 | 7/1982 | Suter . | |
| 4,358,466 | 11/1982 | Stevenson | 426/118 |
| 4,428,477 | 1/1984 | Cristofolo . | |
| 4,461,031 | 7/1984 | Blamer | 426/113 |
| 4,571,337 | 2/1986 | Cage et al. | 426/118 |
| 4,596,713 | 6/1986 | Burdette | 426/107 |
| 4,691,374 | 9/1987 | Watkins et al. | 426/107 |
| 4,718,738 | 1/1988 | Bell | 383/121 |

*Primary Examiner*—Steven Weinstein
*Attorney, Agent, or Firm*—Robbins & Laramie

[57] ABSTRACT

A flexible, generally tubular, three-surface, single-pleated, microwave-penetrable package for use in cooking popcorn. Two transverse seals and one lengthwise-extending seam seal the package. Venting means releases accumulated steam produced by the popping corn and the package maintains its expanded structure even after venting has commenced. A convenient means of opening the package is also provided.

8 Claims, 2 Drawing Sheets

SINGLE-PLEATED MICROWAVE POPCORN PACKAGE

This application is a continuation of application Ser. No. 013,354 filed Feb. 11, 1987, now abandoned.

FIELD OF THE INVENTION

This invention relates to a microwave-penetrable bag that is designed as a package for a product that expands when heated, such as popcorn. The invention is also concerned with a process for making the bag, and a process for popping the popcorn that is packaged in the bag.

BACKGROUND OF THE INVENTION

The majority of microwave popcorn containers presently in use rely on steam pressure to achieve proper package expansion. These containers tend to be quite efficient from a distribution standpoint since they can be shipped and displayed on a store shelf in flattened form, thereby taking up a minimal amount of space. Various patents disclose such packaging. Examples are U.S. Pat. No. 4,571,337 to Cage, U.S. Pat. No. 4,548,826 to Watkins, U.S. Pat. No. 3,973,045 to Brandberg, and U.S. Pat. No. 3,851,574 to Katz.

Although expandable bags are cost-effective, they are not currently the most efficient for popcorn cooking. Two problems are associated with such expandable bag packaging:

(1) Proper expansion of the package is not always achieved. This reduces the space available for the popped kernels and results in a lower yield of finished product; and (2) Heating of the product is not always sufficient. This also results in lower yields.

Problems associated with bag expansion occur for various reasons. In some packaging, venting of steam occurs prematurely. This has been found to be a problem with the bag of Cage et al., U.S. Pat. No. 4,571,337, which relies on a weakened seal area for the venting function. This weakened seal area cannot be precisely controlled due to variations in material thickness and seal strength. Other packaging, such as that disclosed by Brandberg et al. in U.S. Pat. No. 3,973,045, shows a vent which releases steam throughout the entire cooking process. This system of venting is also unreliable because of variations in the rate of steam generated during the cooking process.

An additional cause of poor bag expansion is bag geometry. Ideally, an expandable bag will retain its expanded form when the internal steam pressure declines. This usually occurs in popcorn cooking during the latter stage of the process, when fewer kernels are being popped. Current state-of-the-art packaging relies on bag geometry which allows the bag to collapse during the early stages of steam ventilation, and only retain its expanded form during the latter stage of the cooking process.

A further problem associated with current state-of-the-art popcorn packages relates to adequately heating the popping corn within the package. Such problems are due primarily to a transfer of heat from the package to the oven floor. The Borek patent, U.S. Pat. No. 4,219,573, teaches the use of a cardboard pad to solve this problem. Although this solution is only a partial one, the packaging materials expense is increased by this solution. Bohrer et al., U.S. Pat. No. 4,553,010, describes an attempted solution to the heat transfer problem through the use of a microwave-interactive material such as a metallized polyester. This type of technology could be applied to an expandable bag. However, as with other solutions, packaging costs are increased.

In addition to the problems relating to expansion of the package and heating of the product, most microwave popcorn packages lack a convenient means for opening the package. Such convenient opening means is particularly important in microwave popcorn packaging due to the possibility of burns from escaping steam as the package is opened.

SUMMARY OF THE INVENTION

In one embodiment, the present invention comprises a flexible package constructed of material which is penetrable by microwave energy. The package is formed from roll stock or sheet stock on horizontal or vertical form, fill and seal machinery. The package is generally flat when empty, but is capable of expanding its internal volume to accommodate an expansion of its contents. The sheet stock used to form the package has lengthwise-extending marginal portions opposed to each other which are folded to confront and engage each other. Along the area of engagement, the two marginal portions are sealed together to form a lengthwise-extending seam. A folding of the now-seamed piece of sheet stock provides at least one lengthwise-extending pleat and at least two lengthwise-extending planar outer margins defined by folded portions of the sheet stock. The planar outer margins are parallel with each other and at least one lengthwise-extending pleat which projects away from the plane of the outer margins and is defined by a fold in the sheet stock. The lengthwise-extending extremities comprise the edges of the package.

The seam is disposed intermediate the two edges of the package, and is spaced from each of them. The pleat has a fold line that is located substantially opposite the lengthwise-extending seam when the package is in its flattened form. The pleat is free for movement relative to the rest of the package. The ends of the length of sheet stock are transversely sealed together to form a closed package.

When expanded, the package is tubular, with a configuration comprising three surfaces and three heat-sealable closures. The package is sealed transversely at each end, and a seam extending from one end of the package to the other comprises the third closure.

The three-surface, single-pleated structure provides a positive vent mechanism and a rigid structure when expanded. When a charge of unpopped popcorn kernels is cooked in the package, the steam released by the kernels is retained in the package until full expansion of the package occurs. Only after full expansion, is there sufficient stress created to cause an opening at the package end where a transverse seal, the lengthwise-extending seam and the fold line intersect to form the venting means for the package. Even as the steam is released, the package maintains its expanded structure, thereby providing more space in which the kernels may pop. An additional aspect of the expanded geometry of the three-surface, single-pleated package is the minimal amount of contact between the package and the oven floor. The minimal contact reduces the amount of heat transferred from the package and the popcorn product to the microwave oven floor, therefore improving the yield of popped corn.

A further advantage of the three-surface, single-pleated package is its ease of opening. The lengthwise-extending seam and the fold line are located substantially opposite each other such that a consumer wishing to open the package need merely grasp the pleat in one hand, grasp the seam in the other hand, and pull in opposite directions. The package readily opens along a transverse seal to allow access to the popped corn.

The process for forming and filling the package comprises advancing the microwave penetrable sheet stock in a lengthwise direction and folding at least a part of the sheet stock into a generally tubular form which has a longitudinal axis extending lengthwise of the sheet stock. Free, lengthwise-extending marginal portions of the sheet stock are then folded to confront and engage each other. The sealing of the engaged marginal end portions to form a lengthwise-extending seam that defines the generally tubular structure is the next step of the process followed by the folding of the sheet stock to define the outer margins of the tubular form. The sheet stock is cut and sealed transversely to form the top closure of the package after a predetermined amount of kernels have been dispensed into the package.

When the filled popcorn package is placed in a microwave oven for cooking, its pleated face is adjacent the oven floor. As microwave energy is applied to the package contents, the popcorn kernels pop and release steam and vapor which cause the package to expand. During expansion, the package changes geometry such that only one surface of the package makes minimal contact with the oven floor.

The cost of the package and the final product are below that for most prior art products, because there are no specialized materials or equipment necessary to produce the product.

DETAILED DESCRIPTION OF THE INVENTION

Popcorn packages suitable for use in a microwave oven and constructed in accordance with the present invention are shown in FIGS. 1 through 8. The popcorn package is formed from roll stock or sheet stock on either vertical or horizontal form, fill and seal mechinery.

Figure 1:
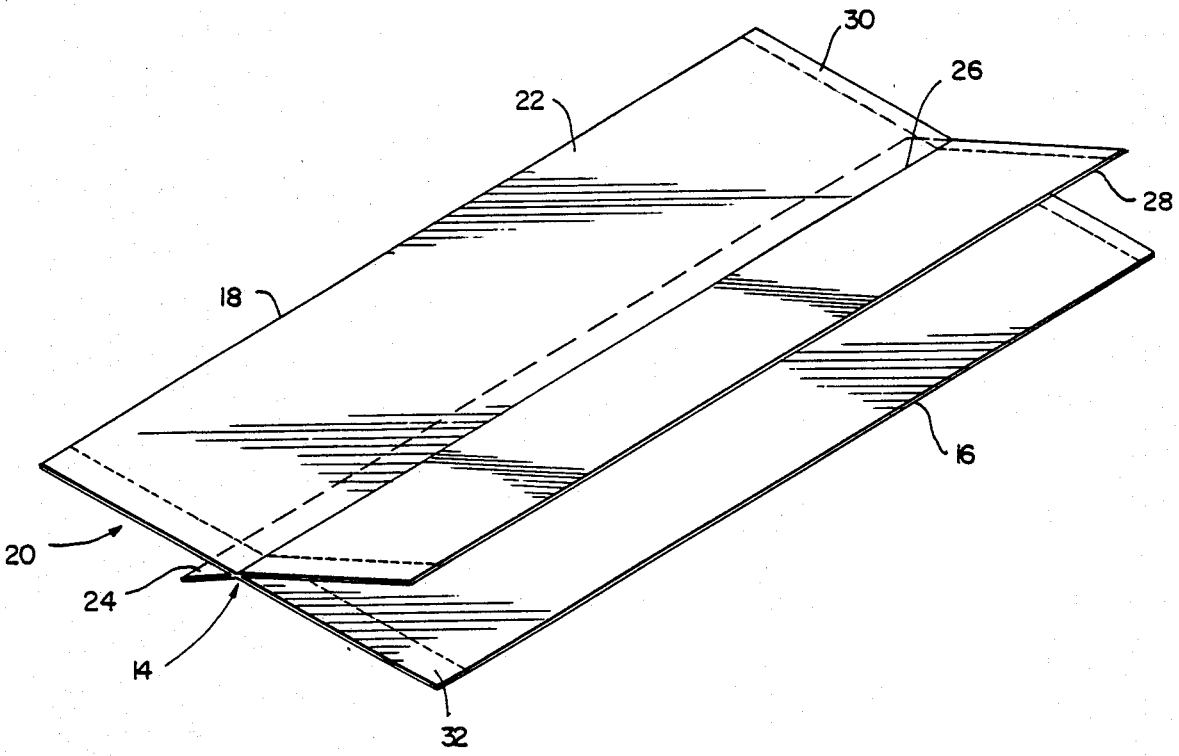
FIG. 1 is a perspective view of the three-surface, single-pleated microwave popcorn package in an unexpanded flattened form.

FIG. 1 shows the generally flattened tubular structure that is formed as the roll stock or sheet stock material proceeds through the form, fill and seal machinery. A lengthwise-extending seam 14 is disposed on a package face 20, intermediate two lengthwise-extending planar outer margins 16 and 18. The two lengthwise-extending planar outer margins 16 and 18 comprise the edges of the two faces 20 and 22 of the generally tubular structure. The seam 14 is formed from the sheet stock by folding opposed marginal portions of the sheet stock so that they confront and engage each other, and then sealing the two together to form the seam 14. The seam 14 is sealed by heat, pressure, a combination of heat and pressure or any other suitable sealing mechanism. Joining the opposing marginal portions of the sheet stock material to form the seam 14 results in the formation of a projection which extends from the face 20 away from the plane of the outer margins 16 and 18. The width of the seam 14 is approximately $\frac{3}{4}$ inch. The width of the laterally extending projection 24 makes it easy to grasp, which is important because of the seam's use in the opening of the package. Also illustrated in FIG. 1 is the location of the seam 14 on the face 20 of the generally flat rectangular package. Although the seam 14 may be disposed on the package face 20 at any location intermediate the two outer margins 16 and 18, the seam 14 is preferably disposed at the center of the package face 20 as shown in FIG. 1. This preferred embodiment produces optimal cook performance because of the venting means opening size which is optimized with this particular package structure.

The generally tubular structure formed by sealing the opposed marginal portions of the sheet stock is next folded such that the two outer margins 16 and 18 comprise the edges of the two opposing faces 20 and 22. The tubular structure is further folded so that a lengthwise-extending pleat 27 is disposed on package face 22 intermediate the two outer margins 16 and 18. The pleat 27 is defined by a fold line 28 which projects away from the plane of the outer margins. When the generally tubular structure is in its flattened form, the pleat 27 is folded at an fold line 26 so that it lies against face 22 of the package. If the pleat 27 were folded away from the face 22 of the package, and the package balanced on the outer fold line 28 of the pleat, the package would have a T-shape with the pleat 27 representing the vertical base and the seamed face 20 representing the horizontal cross-bar of the "T". FIG. 1 most clearly shows the shape of the package when it emerges from the form, fill and seal machinery.

Figure 2:
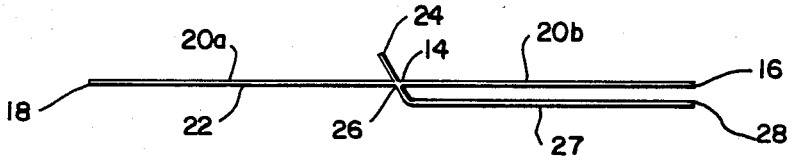
FIG. 2 is a top view of the preferred embodiment of the three-surface, single pleated microwave popcorn package.

In a preferred embodiment, illustrated by FIG. 2, the outer fold line 28 will substantially align with an outer margin 16 of the package when the pleat 27 is folded flat against face 22 of the package. Also shown in FIG. 2 is the location of the seam 14 in relation to the pleat 27. When the package is in its flattened form, the fold line 26, on face 22, is preferably directly opposite to the seam 14, on the opposite face 20 when viewed along a transverse seal 30. The fold line 26 and the seam 14 are also preferably centered with respect to the outer margins 16 and 18. The location of the pleat 27 is important for an adequate opening mechanism for the package. An easy opening mechanism is utilized after the contents of the package have been fully cooked. The easy opening mechanism for the package involves grasping the projection 24 of the seam 14 in one hand and grasping the pleat 27 in the other hand and then pulling apart. The pulling apart causes the package to open along the transverse seal 30.

The location of the fold line 26 with respect to the seam 14 may be varied within limits. The limitations are defined by the openability of the package. If the distance between the seam 14 and the fold line 26 measured along the transverse seal 30 of the package end is too large, the ease of opening the package will be lost. Ease of opening is maintained so long as the distance between the seam 14 and the fold line 26 measured along the transverse seal 30 is about one inch or less. Also related to the location of the pleat 27 on the package is the position of the outer fold line 28. In a preferred embodiment, the outer fold line 28 is aligned with an outer margin 16 of the package when the package is in its flattened form shown in FIG. 2.

The width dimension of the pleat 27 may be varied considerably without affecting the package performance, however, a pleat width of one-half inch of less contributes to an increased incidence of seam rupture during popping of the corn kernels. Rupture of the seam 14 and the subsequent release of popped corn into the microwave oven is an undesirable result, therefore the pleat 27 has a width dimension greater than about one inch, and preferably about two and a half inches.

Transverse seals 30 and 32 are located at the ends of the package and serve to seal the package from the environment. The transverse seals 30 and 32 are formed by severing the folded sheet stock with transverse cuts across the sheet stock's longitudinal axis. The transverse cuts are made so as to sever the folded sheet stock into a desired length for the package. The open ends caused by the severing are then sealed closed by heat, pressure, a combination of heat and pressure or any other suitable sealing mechanism. The transverse seals 30 and 32 may also be formed by a simultaneous cutting and sealing operation. The transverse seals 30 and 32 seal together the package faces 20 and 22 including the pleat 27, but leave the pleat 27 unsecured to the other transverse edges while the pleat itself between the transverse seals is free to expand as well as the portions of the package between the transverse seals.

Transverse seal 30 is located at the top of the package and transverse seal 32 is located at the bottom. The bottom seal 32 is wider than the top seal 30 in order to insure that the package will vent and open at the top and not at the bottom. The bottom seal 32 is about one inch wide, in contrast to the transverse seal 30, which is approximately one-half inch wide. The widths of the transverse seals 30 and 32 are defined by the respective dotted lines at each seal.

Figure 3:
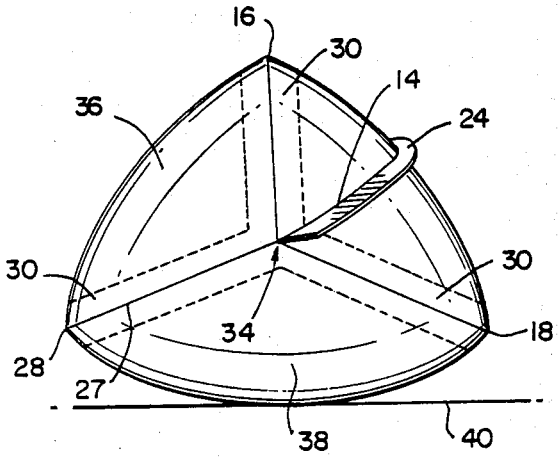
FIG. 3 shows the three-surface, single-pleated microwave popcorn package in an expanded form as it would be after the popcorn had been fully cooked in a microwave oven.

FIG. 3 shows the package in its expanded form after some or all of the popcorn has been cooked. FIG. 3 best illustrates a venting means 34 which is located at a point at the end of the package where the transverse seal 30, the seam 14 and the fold line 26 of the pleat 27 substantially coincide. The location of the venting means 34 comprises a major stress point at one end of the package. The venting means 34 allows the escape of accumulated steam from the inside of the package. As the unpopped popcorn kernels in the package cook, they release steam and vapor which cause the pressure inside the package to increase and the package to expand. As the interior pressure of the package increases, the stress created causes the venting means 34 to open in preference to a rupture of the seam 14 due to the width requirements of the pleat 27. The venting means 34 also opens in preference to the bottom transverse seal 32 which is wider than the top transverse seal 30, which comprises the venting means.

The width of the pleat 27 is greater than one inch and preferably about two and a half inches. The width of the pleat 27 allows a substantial expansion of the package before sufficient stress to open the venting means 34 has been reached. The venting means 34 does not open until the package is completely expanded. The venting means opens first due to the geometry of the package, which makes the venting means 34 the major stress point of the expanded package.

The positioning of the lengthwise-extending seam 14 and the pleat 27, relative to each other, also effects the opening of the venting means 34. Table I below shows the results of bag openability tests when the position of the lengthwise-extending seam 14 is changed relative to the fold line 26. The first column of the table indicates the position of the lengthwise-extending seam 14 relative to the fold line 26. The negative numbers indicate that the seam was located to the left of the fold line when viewed from the top of the package, whereas the positive numbers indicate the positioning of the seam to the right of the fold line. The second column in the table designates the percentage of packages in which the venting means 34 opened in preference to the seam 14. The third column in the table indicates the number of tests conducted with the seam 14 in the given position.

TABLE 1

| Position of Seam 14 Relative to Fold Line 26 (Inches) | Percentage of Packages Which Opened at Venting Means 34 | Number of Tests Conducted |
|---|---|---|
| −1½ | 0 | 2 |
| −1 | 0 | 2 |
| −¾ | 0 | 5 |
| −½ | 85 | 7 |
| 0 | 100 | 7 |
| +½ | 57 | 7 |
| +1 | 50 | 2 |
| +1½ | 0 | 2 |
| +2 | 0 | 2 |

When expanded, as shown in FIG. 3, the package has three major surfaces. The package face 20 is one surface, and has the seam 14 disposed thereon. Seam 14 divides surface 20 into the areas designated 20*a* and 20*b* in FIG. 3. Each of the other two surfaces are comprised partly of the package face 22 and partly of the pleat 27. The outer fold line 28 of the pleat is the common edge for these other two surfaces. One of the surfaces 36 consists of the sheet stock material that is bordered on its longitudinal sides by the outer margin 16 and the outer fold line 28. The other surface 38 consists of the sheet stock material that is bordered on its longitudinal sides by the outer margin 18 and the outer fold line 28. The surface 38 is the only one of the three surfaces that comes in contact with the oven floor 40, when the package is in its expanded form.

The expansion of the package, in conjunction with the sealed ends of the package, represented by transverse seals 30 and 32, causes the three surfaces of the package to be generally convexly curved in a longitudinal direction, as well as in a transverse direction. The convex curvature, in both directions, of surface 38, which is in contact with the oven floor 40, results in only a small percentage of the area of surface 38 being in actual contact with the oven floor 40 after the package has expanded. This minimal contact of the surface 38 with the oven floor 40 results in a minimal amount of heat being transferred from the package and its contents to the oven floor as the popcorn cooks. As more heat is retained in the package, the yield of popped corn increases. The minimal contact of surface 38 with the oven floor 40 therefore contributes to a greater yield of popped corn from the present invention than from conventional microwave popcorn bags.

When forming the single pleated package, microwave penetrable roll stock or sheet stock is advanced through form, fill and seal machinery. The sheet stock is advanced in a direction lengthwise of the stock and folded to produce a generally tubular form with a longitudinal axis extending lengthwise of the stock. The free lengthwise-extending marginal portions of the stock are folded so that they confront and engage each other. The confronting marginal portions are then sealed to form the lengthwise-extending seam 14. The folds made to bring the marginal portions into engagement with one another comprise lengthwise-extending planar outer margins 16 and 18 which are parallel to each other and define the edges of opposing faces 20 and 22 of the generally tubular structure.

The generally tubular structure is next folded to define at least one lengthwise-extending pleat 27 which is disposed on face 22 opposed to the seam 14 on face 20. A transverse cut is then made across the sheet stock and sealed to form the transverse seal 32 which defines the bottom end of the package. A specified amount of unpopped popcorn kernels, that when fully cooked will substantially fill the package, is then dispensed into the generally tubular structure. Finally, a second transverse cut is made across the sheet stock and sealed to form the top transverse seal 30. At this time, the package is completely formed and severed from the sheet stock.

When dispensed from the form, fill and seal machinery, the package is in a flattened form with pleat 27 folded against the package face 22. In this flattened form, the package may be folded or rolled for convenient packaging of multiple package units for consumer use.

When used in a microwave oven, the package is first unfolded or unrolled to its generally flattened form as when dispensed from the form, fill and seal machinery. The package is then placed in the oven with the pleat 27, still folded against the face 22, adjacent the oven floor. Microwave energy is then applied to the corn kernels through the package for a sufficient time to pop substantially all the kernels.

Figure 4:
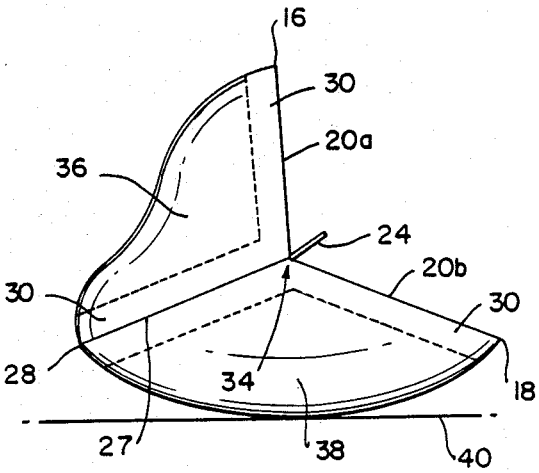
FIG. 4 shows the three-surface, single-pleated microwave popcorn package in a partially expanded form as it would be after the popcorn had begun to cook.

As the popcorn kernels pop, they release steam and vapor which cause the package to expand. The expansion of the pleat 27 creates surfaces 36 and 38. Surface 38 is the only surface that comes into contact with the oven floor. FIG. 4 shows the package in a partially expanded form, immediately after the pleat 27 has expanded sufficiently to create surfaces 36 and 38.

When the package has fully expanded, it has a generally triangular, three-surface, tubular shape with closed ends, as shown in FIG. 3. An advantage of this structure is the minimal contact between the package and its contents and the microwave oven floor. This minimal contact feature is due to the longitudinal convex curvature and the transverse convex curvature of surface 38 of the expanded package which makes less contact with the oven floor than does the flat end of a conventional microwave popcorn bag. The minimal contact between the package and the oven floor reduces the heat transfer from the package and its contents to the oven floor. As more heat is retained in the package and its contents, more kernels are popped to increase the yield of popcorn from the single pleated package of this invention.

An increased yield of popcorn is also realized due to the retention, by the package, of its expanded structure even after venting of accumulated steam has commenced. After the package has fully expanded, the venting means 34 opens when sufficient stress has been created by the steam and vapor of the popping kernels. Even after the opening of the venting means 34, the release of vapor and the subsequent reduction of the interior pressure and stress, the package retains its expanded structure as shown in FIG. 3. The retention of an expanded structure permits the corn kernels more volume in which to expand after popping. The surfaces of the package do not collapse back upon the corn kernels and already popped corn as do the surfaces of conventional microwave popcorn bags after ventilation of accumulated steam. The lack of excess weight and pressure from collapsed package surfaces on the unpopped corn allows the popping kernels to expand to a more complete extend and therefore produce a greater yield of a fluffier, more desirable popcorn product.

The improved yields from the popcorn package of the invention over conventional microwave popcorn bags is illustrated by the following table which shows the results of a comparison of the single pleated package of the invention with a pillow pouch bag and a gussetted bag. Equal amounts of package material and popcorn kernels were used for each of the three bags. An 18"×11" sheet of suitable microwave transparent material was used to make each bag, and 80 grams of popcorn kernels were sealed inside each bag. Each bag was placed in a 625 watt General Electric microwave oven for a five minute cook time, and the resultant yields were as follows:

TABLE II

| Bag Style | Yield Obtained in Cups |
|---|---|
| Single Pleated Bag | 8.1 |
| Pillow Pouch Bag | 6.3 |
| Gussetted Bag | 6.5 |

In general, the single pleated microwave popcorn package produces an 8–10 cup yield of popped corn from an initial charge of approximately 80 grams of popcorn kernels. This yield is produced after cooking the popcorn kernels for about three to five minutes in a microwave oven.

In one embodiment, the roll stock material from which the package is made comprises fluorocarbon-treated paper laminated to a 48-gauge heat-sealable polyester such as Dupont's OL®. The paper is an excellent surface for printing the identity of the product and manufacturer and instructions for consumer use. The fluorocarbon treatment serves to eliminate any oil stains on the package from the internal product by resisting the penetration of fats and oils, and the polyester is an excellent adhesive for the package seals, as it is heat-sealable. Any commercially available stain inhibitor may be used in place of the fluorocarbon treatment. Any material used to form the package should be microwave-penetrable and heat-sealable, yet able to withstand temperatures in the range of 350° F., since this temperature is the approximate cook temperature of popcorn.

An alternative embodiment of the microwave popcorn package of this invention is formed on form, fill and seal machinery from roll stock or sheet stock material comprising a paper with a polyvinyl acetate sealant applied in register. A heat-sealable polyester without the paper backing is also a suitable material. A paper without stain inhibitor treatment may be used if oils are not used in the bag. The overall package size may also be varied according to the amount of popcorn kernels to be added to the package and the estimated yield of popped corn.

Figure 5:
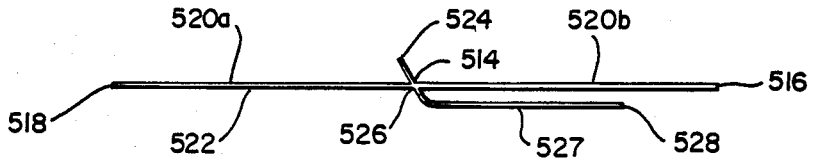
FIG. 5 is a top view of an alternative embodiment of the three-surface, single-pleated microwave popcorn package, in which the outer edge of the lengthwise-extending pleat does not extend as far as the edges of the generally tubular structure.
Figure 6:
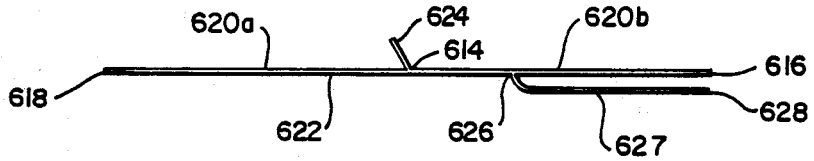
FIG. 6 is a top view of an alternative embodiment of the three-surface, single pleated microwave popcorn package, in which the lengthwise-extending seam and the fold line of the pleat are not aligned opposite each other, when the package is in a flattened form.

FIGS. 5, 6, 7 and 8 show alternative embodiments of the invention in which the locations of the lengthwise-extending seam 14 and the lengthwise-extending pleat 27 are varied. Numbered features in the alternative embodiments are in the one hundreds series which correspond to the figure numbers, in order to clearly distinguish the variation of the features in such embodiments. Numbered features of FIG. 5 are in the five hundreds series, those in FIG. 6 are in the six hundreds series, etc.

In FIG. 5, the seam 514 and the fold line 526 are located opposite each other, and both the seam 514 and the fold line 526 are positioned in the center of their respective package faces. Additionally, the outer fold line 528 is not aligned with the outer margin 516 in FIG. 5.

FIG. 6 shows a package in which the seam 614 and the fold line 626 are not substantially opposite each other, but are within about one inch of each other, as measured along the transverse seal 630. In this embodiment, the outer fold line 628 is in alignment with the outer margin 616 and the seam 614 is located substantially in the center of the package face 620.

Figure 7:
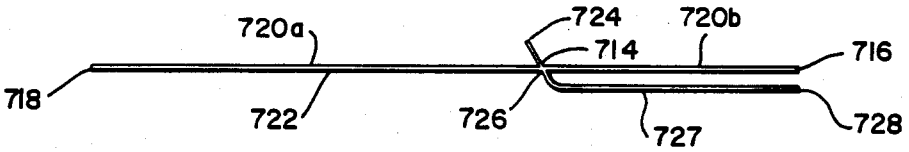
FIG. 7 is a top view of an alternative embodiment of the three-surface, single-pleated microwave popcorn package, in which the fold line and the lengthwise extending seam are not centered with respect to the bag edges.

FIG. 7 shows an embodiment in which the seam 714 and the fold line 726 are located opposite each other, but the seam 714 and the fold line 726 are not positioned in the center of their respective package faces. The outer fold line 728 is in alignment with the outer margin 716 in the embodiment illustrated by FIG. 7.

Figure 8:
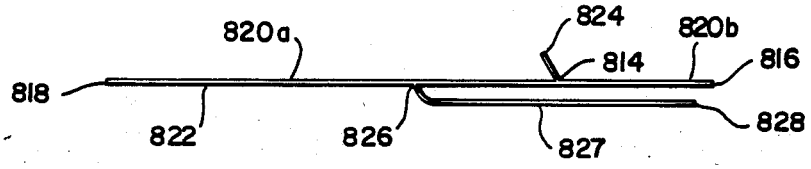
FIG. 8 is a top view of a further alternative embodiment of the three-surface, single-pleated microwave popcorn package, in which the lengthwise-extending seam and the fold line of the pleat are not aligned opposite each other, when the package is in a flattened form.

FIG. 8 illustrates an alternative embodiment in which the seam 814 is located off-center in relation to the package face 820 on which it is positioned. The inner fold line 826 is not substantially opposite the seam 814, but is within one inch of the seam 814 as measured along the transverse seal 830. The outer fold line 828 is substantially aligned with the outer margin 816.

While the invention has been disclosed by reference to the details of preferred embodiments, this disclosure is intended in an illustrative rather than in a limiting sense, as it is contemplated that modifications will readily occur to those skilled in the art, within the spirit of the invention and the scope of the appended claims.

What is claimed is:

1. A package formed from a length of microwave energy transparent sheet material, said sheet material forming said package having longitudinally extending opposed marginal edges, said package comprising two substantially planar opposed faces of said sheet material defining a product-containing chamber and a heat-expandable food product therein; two opposed longitudinally extending fold lines in said sheet material joining the longitudinal periphery of said opposed faces; a longitudinally-extending seam intermediate said fold lines, integral with and projecting away from said one of said face, outside the plans of said one face, said seam comprising a seal between said opposed marginal edges such that said edges are sealed to each other in face to face congruent fashion; and a longitudinally-extending pleat intermediate said fold lines, integral with and projecting away from said face opposite said one of said faces, outside the plane of said opposite face, said pleat comprising an additional fold line in said sheet material and additional opposed faces and foldable to lie against said opposite face, said package further comprising two opposed transverse seals extending substantially along only the transverse edges of said package to seal the product contained therein, said transverse seals sealing said opposed faces to each other along said transverse edge and sealing said additional opposed faces to each other that constitute said pleat, said sheet material being otherwise unsealed between said opposed faces and said additional opposed faces and the orientation and configuration of said pleat and said transverse seals being such that when said package is placed in a microwave oven with said pleat folded against said opposite face adjacent the oven floor and microwave energy applied to the package, the expandable product will cause the expansion of said pleat creating a three-surface, generally tubular structure with sealed transverse edges each surface having one common edge with each of the other surfaces and each surface convexly curved around between the sealed transverse edges and between its common edges such that only one of said surfaces of the package contacts said oven floor and makes minimal contact between the package and the microwave oven floor thereby reducing heat transfer from said package to said floor, at least one of said sealed transverse edges being peelable after microwave heating so that said package is openable by grasping said pleat and said seam and pulling in opposite directions so that the package opens along said peelable transverse seal.

2. The package of claim 1 in which said length of sheet material comprises paper laminated to a heat-sealable polyester.

3. The package of claim 2 wherein said sheet material comprises paper which is coated on the surface which is to be the interior of said package with a heat-sealable synthetic plastic.

4. The package of claim 3 wherein said paper is treated to resist penetration by fats and oils.

5. The package of claim 1 wherein said product comprises a charge of unpopped popcorn kernels.

6. The package of claim 5 in which said charge of unpopped popcorn kernels is a sufficient amount that when completely popped will substantially fill the interior volume of said package.

7. The package of claim 5 wherein said product further comprises a quantity of oil sufficient to thinly coat the unpopped popcorn kernels.

8. The package of claim 1 further comprising a venting means located at a point where said longitudinally-extending seam and one of said sealed transverse edges intersect.

* * * * *

UNITED STATES PATENT AND TRADEMARK OFFICE

CERTIFICATE OF CORRECTION

PATENT NO. : 4,892,744

DATED : January 9, 1990

INVENTOR(S) : Jon A. YLVISAKER

It is certified that error appears in the above-identified patent and that said Letters Patent is hereby corrected as shown below:

In the specification, at column 4, line 10, "mechinery" should read -- machinery --.

In claim 1, at column 10, line 5, "plans" should read -- plane --.

Signed and Sealed this

Eighth Day of January, 1991

*Attest:*

*Attesting Officer*

HARRY F. MANBECK, JR.

*Commissioner of Patents and Trademarks*